US010990117B2

(12) United States Patent
Chao et al.

(10) Patent No.: US 10,990,117 B2
(45) Date of Patent: Apr. 27, 2021

(54) P-TYPE METAL-OXIDE-SEMICONDUCTOR (PMOS) LOW DROP-OUT (LDO) REGULATOR

(71) Applicant: QUALCOMM Incorporated, San Diego, CA (US)

(72) Inventors: Yue Chao, San Diego, CA (US); Marco Zanuso, Encinitas, CA (US); Rajagopalan Rangarajan, San Diego, CA (US); Yiwu Tang, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 0 days.

(21) Appl. No.: 16/561,839

(22) Filed: Sep. 5, 2019

(65) Prior Publication Data

US 2021/0072778 A1 Mar. 11, 2021

(51) Int. Cl.
*G05F 1/575* (2006.01)
*G05F 1/595* (2006.01)

(52) U.S. Cl.
CPC ..... *G05F 1/575* (2013.01); *G05F 1/595* (2013.01)

(58) Field of Classification Search
CPC ..... G05F 1/575; G05F 1/595
See application file for complete search history.

(56) References Cited

U.S. PATENT DOCUMENTS

| | | | | |
|---|---|---|---|---|
| 6,956,437 | B2 * | 10/2005 | Lopez | G05F 3/205 330/289 |
| 2011/0115556 | A1 * | 5/2011 | May | G05F 1/618 327/540 |
| 2017/0364111 | A1 * | 12/2017 | Flaibani | H02M 3/04 |
| 2018/0017982 | A1 * | 1/2018 | Song | G05F 1/468 |
| 2019/0302820 | A1 * | 10/2019 | Yasusaka | G05F 1/575 |
| 2020/0286574 | A1 * | 9/2020 | Kunz | G01R 19/16552 |

* cited by examiner

*Primary Examiner* — Kyle J Moody
(74) *Attorney, Agent, or Firm* — Patterson & Sheridan, LLP

(57) ABSTRACT

Certain aspects of the present disclosure provide a low drop-out (LDO) regulator. The LDO regulator generally includes a first p-type metal-oxide-semiconductor transistor (PMOS) having a drain coupled to an output node of the LDO regulator, a first amplifier having an input coupled to a reference voltage node and an output coupled to a gate of the first PMOS transistor, a second PMOS transistor having a source coupled to the output node, and a second amplifier having an input coupled to the output node and an output coupled to a gate of the second PMOS transistor.

24 Claims, 6 Drawing Sheets

P-TYPE METAL-OXIDE-SEMICONDUCTOR (PMOS) LOW DROP-OUT (LDO) REGULATOR

TECHNICAL FIELD

Certain aspects of the present disclosure generally relate to electronic circuits and, more particularly, to a low drop-out (LDO) regulator.

BACKGROUND

A wireless communication network may include a number of base stations that can support communication for a number of mobile stations. A mobile station (MS) may communicate with a base station (BS) via a downlink and an uplink. The downlink (or forward link) refers to the communication link from the base station to the mobile station, and the uplink (or reverse link) refers to the communication link from the mobile station to the base station. A base station may transmit data and control information on the downlink to a mobile station and/or may receive data and control information on the uplink from the mobile station. The base station and/or mobile station may include radio frequency (RF) front-end circuitry. The base station and/or mobile station may include one or more regulators to generate supply voltages for electrical components of the RF front-end circuitry.

SUMMARY

Certain aspects of the present disclosure are directed to a low drop-out (LDO) regulator implemented using p-type metal-oxide-semiconductor (PMOS) transistors and a high bandwidth feedback loop.

Certain aspects of the present disclosure provide an LDO regulator. The LDO regulator generally includes a first PMOS having a drain coupled to an output node of the LDO regulator, a first amplifier having an input coupled to a reference voltage node and an output coupled to a gate of the first PMOS transistor, a second PMOS transistor having a source coupled to the output node, and a second amplifier having an input coupled to the output node and an output coupled to a gate of the second PMOS transistor.

Certain aspects of the present disclosure provide a method for signal amplification. The method generally includes sensing an output voltage at an output node, the output node being coupled to a drain of a first PMOS transistor and a source of a second PMOS transistor, and controlling gates of the first PMOS transistor and the second PMOS transistor based on the sensed output voltage.

Certain aspects of the present disclosure provide an apparatus for voltage regulation. The apparatus generally includes means for sensing an output voltage at an output node, the output node being coupled to a drain of a first PMOS transistor and a source of a second PMOS transistor, and means for controlling gates of the first PMOS transistor and the second PMOS transistor based on the sensed output voltage.

BRIEF DESCRIPTION OF THE DRAWINGS

So that the manner in which the above-recited features of the present disclosure can be understood in detail, a more particular description, briefly summarized above, may be had by reference to aspects, some of which are illustrated in the appended drawings. It is to be noted, however, that the appended drawings illustrate only certain typical aspects of this disclosure and are therefore not to be considered limiting of its scope, for the description may admit to other equally effective aspects.

DETAILED DESCRIPTION

Certain aspects of the present disclosure are directed to a low drop-out (LDO) regulator implemented using p-type metal-oxide-semiconductor (PMOS) transistors. The LDO regulator is implemented with a high bandwidth feedback loop for improving the power supply rejection ratio (PSRR) and reverse PSRR (RPSRR) of the LDO regulator as compared to conventional implementations.

Various aspects of the disclosure are described more fully hereinafter with reference to the accompanying drawings. This disclosure may, however, be embodied in many different forms and should not be construed as limited to any specific structure or function presented throughout this disclosure. Rather, these aspects are provided so that this disclosure will be thorough and complete, and will fully convey the scope of the disclosure to those skilled in the art. Based on the teachings herein, one skilled in the art should appreciate that the scope of the disclosure is intended to cover any aspect of the disclosure disclosed herein, whether implemented independently of or combined with any other aspect of the disclosure. For example, an apparatus may be implemented or a method may be practiced using any number of the aspects set forth herein. In addition, the scope of the disclosure is intended to cover such an apparatus or method which is practiced using other structure, functionality, or structure and functionality in addition to or other than the various aspects of the disclosure set forth herein. It should be understood that any aspect of the disclosure disclosed herein may be embodied by one or more elements of a claim.

The word "exemplary" is used herein to mean "serving as an example, instance, or illustration." Any aspect described herein as "exemplary" is not necessarily to be construed as preferred or advantageous over other aspects.

As used herein, the term "connected with" in the various tenses of the verb "connect" may mean that element A is directly connected to element B or that other elements may be connected between elements A and B (i.e., that element A is indirectly connected with element B). In the case of electrical components, the term "connected with" may also be used herein to mean that a wire, trace, or other electrically conductive material is used to electrically connect elements A and B (and any components electrically connected therebetween).

An Example Wireless System

Figure 1:
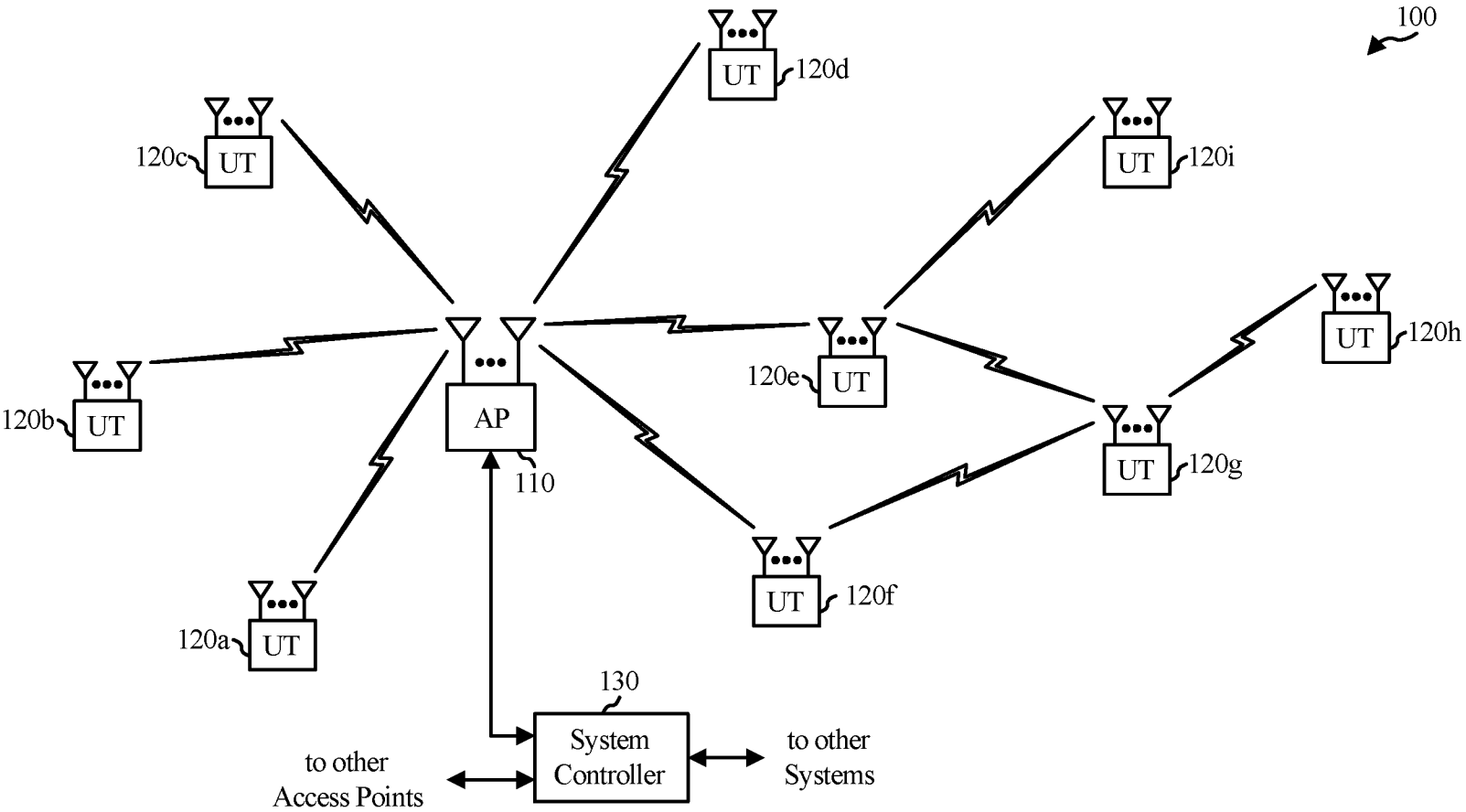
FIG. 1 is a diagram of an example wireless communications network, in accordance with certain aspects of the present disclosure.

FIG. 1 illustrates a wireless communications system 100 with access points 110 and user terminals 120, in which aspects of the present disclosure may be practiced. For simplicity, only one access point 110 is shown in FIG. 1. An access point (AP) is generally a fixed station that communicates with the user terminals and may also be referred to as a base station (BS), an evolved Node B (eNB), or some other terminology. A user terminal (UT) may be fixed or mobile and may also be referred to as a mobile station (MS), an access terminal, user equipment (UE), a station (STA), a client, a wireless device, or some other terminology. A user terminal may be a wireless device, such as a cellular phone, a personal digital assistant (PDA), a handheld device, a wireless modem, a laptop computer, a tablet, a personal computer, etc.

Access point 110 may communicate with one or more user terminals 120 at any given moment on the downlink and uplink. The downlink (i.e., forward link) is the communication link from the access point to the user terminals, and the uplink (i.e., reverse link) is the communication link from the user terminals to the access point. A user terminal may also communicate peer-to-peer with another user terminal. A system controller 130 couples to and provides coordination and control for the access points.

Wireless communications system 100 employs multiple transmit and multiple receive antennas for data transmission on the downlink and uplink. Access point 110 may be equipped with a number $N_{ap}$ of antennas to achieve transmit diversity for downlink transmissions and/or receive diversity for uplink transmissions. A set $N_u$ of selected user terminals 120 may receive downlink transmissions and transmit uplink transmissions. Each selected user terminal transmits user-specific data to and/or receives user-specific data from the access point. In general, each selected user terminal may be equipped with one or multiple antennas (i.e., $N_{ut} \geq 1$). The $N_u$ selected user terminals can have the same or different number of antennas.

Wireless communications system 100 may be a time division duplex (TDD) system or a frequency division duplex (FDD) system. For a TDD system, the downlink and uplink share the same frequency band. For an FDD system, the downlink and uplink use different frequency bands. Wireless communications system 100 may also utilize a single carrier or multiple carriers for transmission. Each user terminal 120 may be equipped with a single antenna (e.g., to keep costs down) or multiple antennas (e.g., where the additional cost can be supported). In certain aspects, the AP 110 and/or user terminals 120 may include a p-type metal-oxide-semiconductor (PMOS) low drop-out (LDO) regulator, as described in more detail herein.

Figure 2:
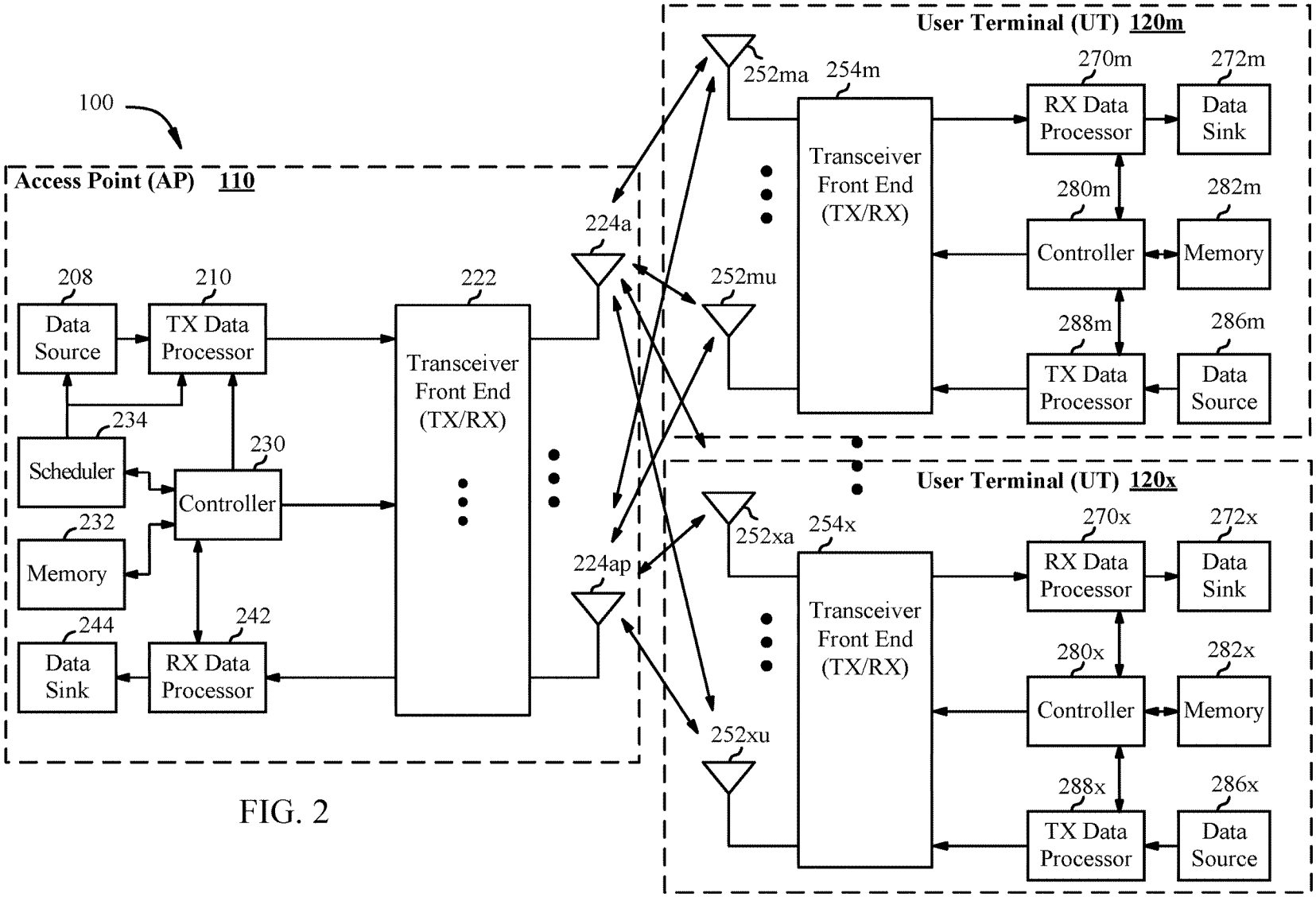
FIG. 2 is a block diagram of an example access point (AP) and example user terminals, in accordance with certain aspects of the present disclosure.

FIG. 2 shows a block diagram of access point 110 and two user terminals 120*m* and 120*x* in the wireless communications system 100. Access point 110 is equipped with $N_{ap}$ antennas 224*a* through 224*ap*. User terminal 120*m* is equipped with $N_{ut,m}$ antennas 252*ma* through 252*mu*, and user terminal 120*x* is equipped with $N_{ut,x}$ antennas 252*xa* through 252*xu*. Access point 110 is a transmitting entity for the downlink and a receiving entity for the uplink. Each user terminal 120 is a transmitting entity for the uplink and a receiving entity for the downlink. As used herein, a "transmitting entity" is an independently operated apparatus or device capable of transmitting data via a frequency channel, and a "receiving entity" is an independently operated apparatus or device capable of receiving data via a frequency channel. In the following description, the subscript "dn" denotes the downlink, the subscript "up" denotes the uplink, $N_{up}$ user terminals are selected for simultaneous transmission on the uplink, $N_{dn}$ user terminals are selected for simultaneous transmission on the downlink, $N_{up}$ may or may not be equal to $N_{dn}$, and $N_{up}$ and $N_{dn}$ may be static values or can change for each scheduling interval. Beam-steering or some other spatial processing technique may be used at the access point and user terminal.

On the uplink, at each user terminal 120 selected for uplink transmission, a TX data processor 288 receives traffic data from a data source 286 and control data from a controller 280. TX data processor 288 processes (e.g., encodes, interleaves, and modulates) the traffic data $\{d_{up}\}$ for the user terminal based on the coding and modulation schemes associated with the rate selected for the user terminal and provides a data symbol stream $\{s_{up}\}$ for one of the $N_{ut,m}$ antennas. A transceiver front end (TX/RX) 254 (also known as a radio frequency front end (RFFE)) receives and processes (e.g., converts to analog, amplifies, filters, and frequency upconverts) a respective symbol stream to generate an uplink signal. The transceiver front end 254 may also route the uplink signal to one of the $N_{ut,m}$ antennas for transmit diversity via an RF switch, for example. The controller 280 may control the routing within the transceiver front end 254. Memory 282 may store data and program codes for the user terminal 120 and may interface with the controller 280.

A number $N_{up}$ of user terminals 120 may be scheduled for simultaneous transmission on the uplink. Each of these user terminals transmits its set of processed symbol streams on the uplink to the access point.

At access point 110, $N_{ap}$ antennas 224*a* through 224*ap* receive the uplink signals from all $N_{up}$ user terminals transmitting on the uplink. For receive diversity, a transceiver front end 222 may select signals received from one of the antennas 224 for processing. The signals received from multiple antennas 224 may be combined for enhanced receive diversity. The access point's transceiver front end 222 also performs processing complementary to that performed by the user terminal's transceiver front end 254 and provides a recovered uplink data symbol stream. The recovered uplink data symbol stream is an estimate of a data symbol stream $\{s_{up}\}$ transmitted by a user terminal. An RX data processor 242 processes (e.g., demodulates, deinterleaves, and decodes) the recovered uplink data symbol stream in accordance with the rate used for that stream to obtain decoded data. The decoded data for each user terminal may be provided to a data sink 244 for storage and/or a controller 230 for further processing.

On the downlink, at access point 110, a TX data processor 210 receives traffic data from a data source 208 for $N_{dn}$ user terminals scheduled for downlink transmission, control data from a controller 230 and possibly other data from a scheduler 234. The various types of data may be sent on different transport channels. TX data processor 210 processes (e.g., encodes, interleaves, and modulates) the traffic data for each user terminal based on the rate selected for that user terminal. TX data processor 210 may provide a downlink data symbol streams for one of more of the $N_{dn}$ user terminals to be transmitted from one of the $N_{ap}$ antennas. The transceiver front end 222 receives and processes (e.g., converts to analog, amplifies, filters, and frequency upconverts) the symbol stream to generate a downlink signal. The transceiver front end 222 may also route the downlink signal to one or more of the $N_{ap}$ antennas 224 for transmit diversity via an RF switch, for example. The controller 230 may control the routing within the transceiver front end 222. Memory 232 may store data and program codes for the access point 110 and may interface with the controller 230.

At each user terminal 120, $N_{ut,m}$ antennas 252 receive the downlink signals from access point 110. For receive diversity at the user terminal 120, the transceiver front end 254 may select signals received from one of the antennas 252 for processing. The signals received from multiple antennas 252 may be combined for enhanced receive diversity. The user terminal's transceiver front end 254 also performs processing complementary to that performed by the access point's transceiver front end 222 and provides a recovered downlink data symbol stream. An RX data processor 270 processes (e.g., demodulates, deinterleaves, and decodes) the recovered downlink data symbol stream to obtain decoded data for the user terminal. In certain aspects, transceiver front ends 222, 254 may include a PMOS LDO regulator, as described in more detail herein.

Figure 3:
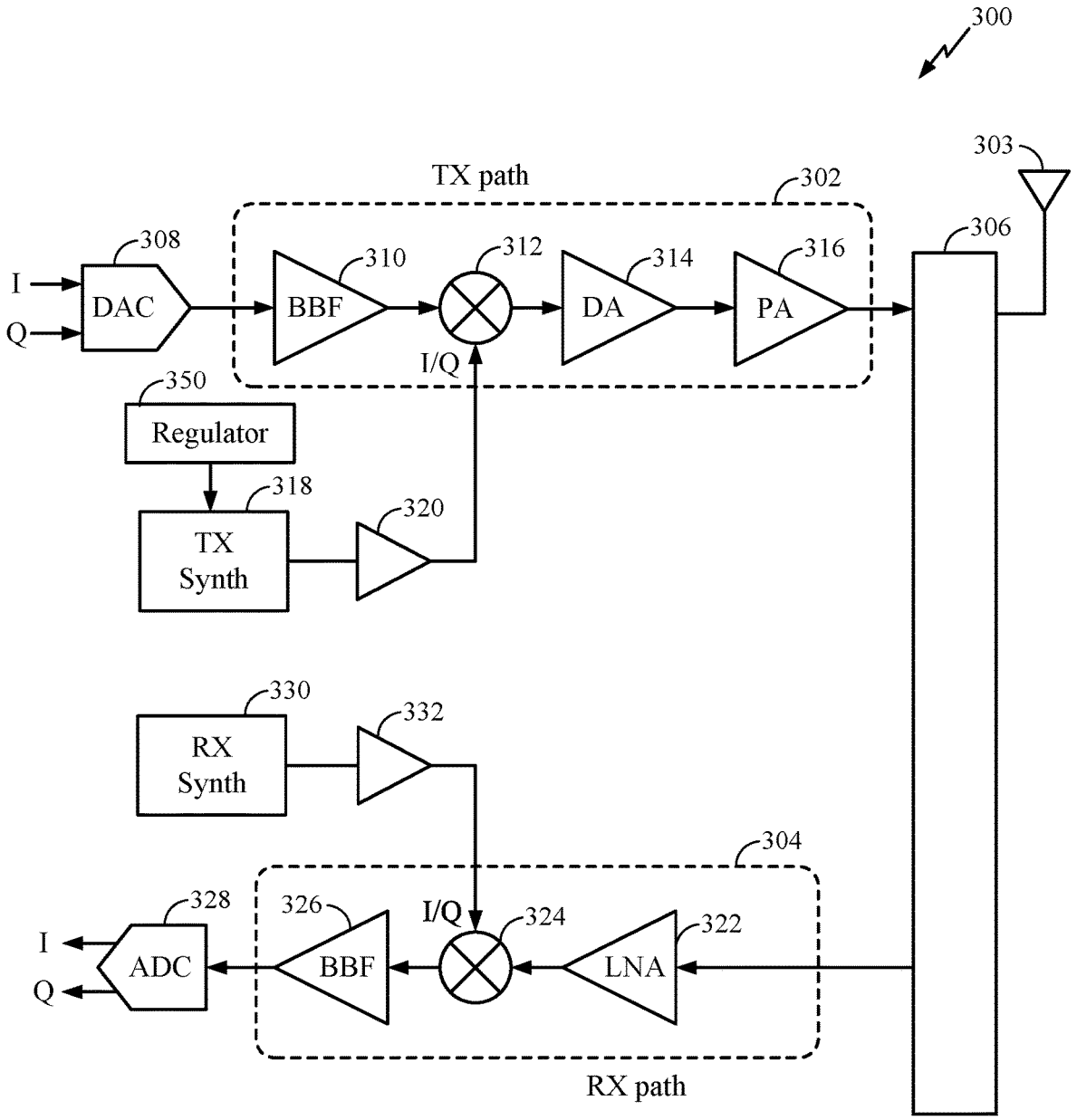
FIG. 3 is a block diagram of an example transceiver front end, in accordance with certain aspects of the present disclosure.

FIG. 3 is a block diagram of an example transceiver front end 300, such as transceiver front ends 222, 254 in FIG. 2, in which aspects of the present disclosure may be practiced. The transceiver front end 300 includes a transmit (TX) path 302 (also known as a transmit chain) for transmitting signals via one or more antennas and a receive (RX) path 304 (also known as a receive chain) for receiving signals via the antennas. When the TX path 302 and the RX path 304 share an antenna 303, the paths may be connected with the antenna via an interface 306, which may include any of various suitable RF devices, such as a duplexer, a switch, a diplexer, and the like.

Receiving in-phase (I) or quadrature (Q) baseband analog signals from a digital-to-analog converter (DAC) 308, the TX path 302 may include a baseband filter (BBF) 310, a mixer 312, a driver amplifier (DA) 314, and a power amplifier (PA) 316. The BBF 310, the mixer 312, and the DA 314 may be included in a radio frequency integrated circuit (RFIC), while the PA 316 may be external to the RFIC.

The BBF 310 filters the baseband signals received from the DAC 308, and the mixer 312 mixes the filtered baseband signals with a transmit local oscillator (LO) signal to convert the baseband signal of interest to a different frequency (e.g., upconvert from baseband to RF). This frequency conversion process produces the sum and difference frequencies of the LO frequency and the frequency of the signal of interest. The sum and difference frequencies are referred to as the beat frequencies. The beat frequencies are typically in the RF range, such that the signals output by the mixer 312 are typically RF signals, which may be amplified by the DA 314 and/or by the PA 316 before transmission by the antenna 303.

The RX path 304 includes a low noise amplifier (LNA) 322, a mixer 324, and a baseband filter (BBF) 326. The LNA 322, the mixer 324, and the BBF 326 may be included in a radio frequency integrated circuit (RFIC), which may or may not be the same RFIC that includes the TX path components. RF signals received via the antenna 303 may be amplified by the LNA 322, and the mixer 324 mixes the amplified RF signals with a receive local oscillator (LO) signal to convert the RF signal of interest to a different baseband frequency (i.e., downconvert). The baseband signals output by the mixer 324 may be filtered by the BBF 326 before being converted by an analog-to-digital converter (ADC) 328 to digital I or Q signals for digital signal processing.

While it is desirable for the output of an LO to remain stable in frequency, tuning the LO to different frequencies typically entails using a variable-frequency oscillator, which involves compromises between stability and tunability. Contemporary systems may employ frequency synthesizers with a voltage-controlled oscillator (VCO) to generate a stable, tunable LO with a particular tuning range. Thus, the transmit LO frequency may be produced by a TX frequency synthesizer 318, which may be buffered or amplified by amplifier 320 before being mixed with the baseband signals in the mixer 312. Similarly, the receive LO frequency may be produced by an RX frequency synthesizer 330, which may be buffered or amplified by amplifier 332 before being mixed with the RF signals in the mixer 324. In certain aspects, a regulator 350 may be used to generate a regulated supply voltage for the TX frequency synthesizer 318 and/or the RX frequency synthesizer 330. The regulator 350 may be implemented as a PMOS LDO regulator, as described in more detail herein.

While FIGS. 1-3 provide a wireless communication system as an example application in which certain aspects of the present disclosure may be implemented to facilitate understanding, certain aspects provided herein can be utilized to generate a regulated supply voltage in any of various other suitable systems. For example, the PMOS LDO regulator described herein can be used to regulate supply voltages in test and measurement equipment.

Example P-Type Metal-Oxide-Semiconductor (PMOS) Low Drop-Out (LDO) Regulator

Fifth-generation (5G) millimeter-wave (mmW) frequency synthesizers (e.g., TX frequency synthesizer 318) are sensitive to supply voltage noise due to a large Kvdd (frequency variation with supply voltage) at mmW frequencies, resulting in challenging noise specifications, large load current specifications, and low drop-out voltage specifications at high efficiencies. A 5G mmW synthesizer may couple noise onto other components due to large charge and discharge currents. Thus, it is important for a low drop-out (LDO) regulator used for 5G mmW synthesizers to have good power-supply-rejection ratio (PSRR) and reverse PSRR (RPSRR) at high efficiencies. PSRR generally refers to the ability of the LDO regulator to maintain an output voltage as the power-supply voltage of the LDO regulator is varied. RPSRR generally refers to the ability of the LDO regulator to prevent coupling of high-frequency signals at the output of the LDO regulator to the power supply voltage.

Conventional LDO regulators designed with an n-type metal-oxide-semiconductor (NMOS) transistor may provide better PSRR as compared to LDO regulators designed with p-type metal-oxide-semiconductor (PMOS) transistors. Moreover, conventional NMOS LDO regulators may be single-pole systems, allowing NMOS LDOs to be designed and stabilized with a wide bandwidth at high frequencies. In contrast, conventional PMOS LDOs may be double-pole systems, resulting in a limited operational bandwidth due to stability issues and degradation of PSRR at high frequencies as compared to NMOS LDOs.

Conventional NMOS LDOs may also provide a lower drop-out voltage as compared to conventional double-regulated LDOs (e.g., implemented with two PMOS transistors, each controlled via a separate amplifier), improving amplification efficiency. However, a gate voltage of an NMOS transistor of the NMOS LDO may be higher than the supply voltage (e.g., Vdd) of the NMOS LDO. Therefore, an NMOS LDO may be unsuitable for operating with a high supply voltage. In contrast, the gate voltage of a PMOS transistor of a PMOS LDO may be operated at a voltage lower than the supply voltage, making PMOS LDOs more suitable for operation with a high supply voltage.

NMOS LDOs may have a worse RPSRR as compared to PMOS LDOs. A double-regulated LDO may have a better PSRR, RPSRR, bandwidth, and stability as compared to both NMOS and PMOS LDOs. However, a double-regulated LDO may have a larger drop-out voltage as compared to NMOS and PMOS LDOs, reducing power efficiency of the system, and may have a smaller output voltage range, as compared to the NMOS and PMOS LDOs. Certain aspects of the present disclosure are generally directed to a PMOS LDO with improved PSRR and RPSRR, as compared to conventional LDO implementations.

Figure 4:
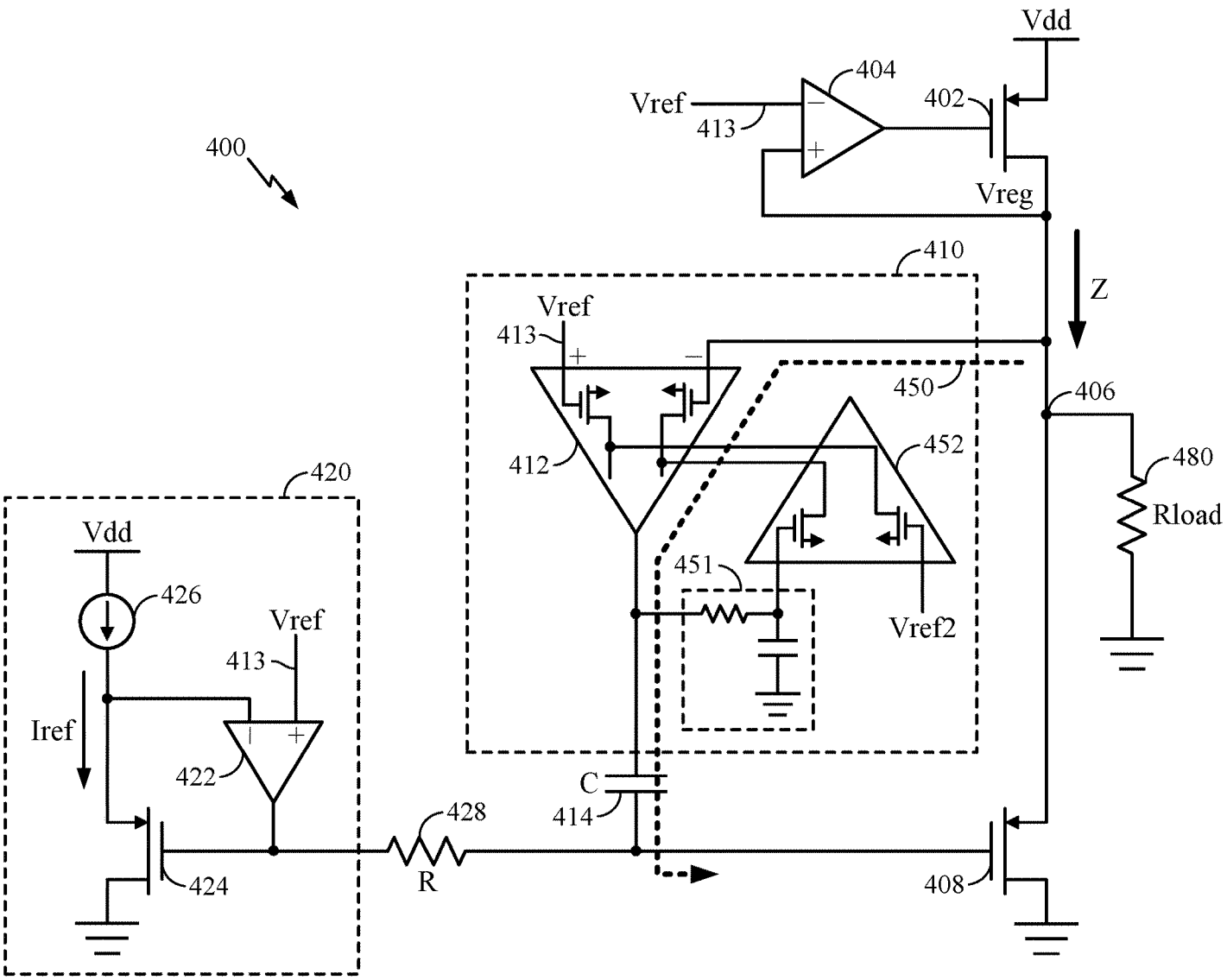
FIG. 4 illustrates an example low drop-out (LDO) regulator, in accordance with certain aspects of the present disclosure.

FIG. 4 illustrates an example LDO regulator 400, in accordance with certain aspects of the present disclosure. The LDO regulator 400 may be at least a part of the regulator 350 described with respect to FIG. 3. The LDO regulator 400 may include a PMOS transistor 402 coupled to an amplifier 404 (e.g., an operational transconductance amplifier (OTA)). For example, a negative terminal of the amplifier 404 is coupled to a reference voltage (Vref) node, and a positive terminal of the amplifier 404 is coupled to a drain of the PMOS transistor 402 at an output node 406 of the LDO regulator 400. As illustrated, a source of the PMOS transistor 402 is coupled to the voltage rail Vdd. The output of the amplifier 404 drives the gate of the PMOS transistor 402 to generate a regulated voltage (Vreg) at the output node 406 based on Vref.

In certain aspects, a PMOS transistor 408 may be coupled to the output node 406. For example, the source of the PMOS transistor 408 may be coupled to the output node 406, and the drain of the PMOS transistor 408 may be coupled to a reference potential node (e.g., electric ground). A feedback loop 450 may be coupled between the output node 406 and the gate of the PMOS transistor 408. For example, the feedback loop 450 may include a control circuit 410 which may be used to drive the gate of the PMOS transistor 408 based on Vreg at the output node 406. The control circuit 410 may include an amplifier 412 (e.g., OTA) having a positive input terminal coupled to the Vref node 413, and a negative input terminal coupled to the output node 406. A capacitive element 414 may be coupled between the output of the amplifier 412 and the gate of the PMOS transistor 408. The capacitive element 414 implements a high-pass filter (HPF) between the output of the amplifier 412 and the gate of the PMOS transistor 408. In this manner, the feedback loop 450 is implemented as a high bandwidth feedback loop. That is, the high bandwidth feedback loop senses and amplifies high-frequency signal components at the output node 406 and sinks current from the output node 406 in response to sensing the high-frequency components by controlling the PMOS transistor 408.

In certain aspects, a biasing circuit 420 may be used to provide a direct-current (DC) bias for the PMOS transistor 408. For example, the biasing circuit 420 may include an amplifier 422 having an output coupled to the gate of a transistor 424. A negative input terminal of the amplifier 422 may be coupled to a current source 426 and the positive input terminal of the amplifier 422 may be coupled to the Vref node 413. The current source 426 may be coupled to the source of transistor 424 to source a reference current (Iref) to the transistor 424. The resistive element 428 along with the capacitive element 414 form a low-pass filter (LPF) between the output of the biasing circuit 420 and the gate of the PMOS transistor 408. Therefore, the biasing circuit 420 provides a DC bias for the PMOS transistor 408 based on the reference current Iref and the reference voltage Vref. Thus, the PMOS transistor 408 is biased such that the PMOS transistor 408 consumes (e.g. sinks to electric ground) a relatively small amount of current (e.g., 0.5 mA) as compared to the load current (e.g., about 30 mA).

The LDO 400 described with respect to FIG. 4 provides several advantages as compared to conventional LDO implementations. For example, the LDO 400 includes a single-pole feedback loop that is easy to design and stabilize with a wide bandwidth. That is, the amplifier 412 forms part of the feedback loop 450 that senses high-frequency signals (e.g., noise) at the output node 406, and controls the PMOS transistor 408 such that the high-frequency noise is directed to electric ground. In other words, at frequencies higher than the resistor-capacitor (RC) pole frequency of the RC circuit formed by the resistive element 428 and the capacitive element 414, the gain of the feedback loop 450 creates a low impedance path from the output node 406 to electric ground, improving PSRR. Moreover, the RPSRR is also improved due to the low impedance (Z) looking to output node 406 from the drain of PMOS transistor 402. Therefore, load current spikes may be directed to electric ground, reducing impact to the power supply and improving RPSRR. The RC circuit formed by resistive element 428 and capacitive element 414 may be used not only to DC bias the PMOS transistor 408, but also to provide a large impedance load at the output of amplifier 412 for high gain at high frequencies. The LDO 400 also has a small drop-out voltage that is less than a conventional double-regulated LDO. In certain aspects, the PMOS transistor 408 may be turned off or disconnected from the output node 406 to configure the LDO as a conventional PMOS LDO. The PMOS transistor 408 may be turned off by turning off the current source 426 and pulling the gate voltage of the PMOS transistor 408 down to the reference potential (e.g., electric ground).

In some cases, a DC offset may be present at the output of the amplifier 412, causing a DC offset mismatch between the amplifier 404 and the amplifier 412, which may result in the amplifier 412 operating in saturation. In certain aspects, a DC feedback circuit may be implemented to cancel (or at least reduce) the DC offset associated with the amplifier 412. For example, a LPF 451 may be coupled between the output of the amplifier 412 and an input of a transconductance circuit 452. The transconductance circuit 452 sinks current from the amplifier 412, cancelling (or at least reducing) a DC offset that may be present at the output of the amplifier 412, as described in more detail with respect to FIG. 5.

Figure 5:
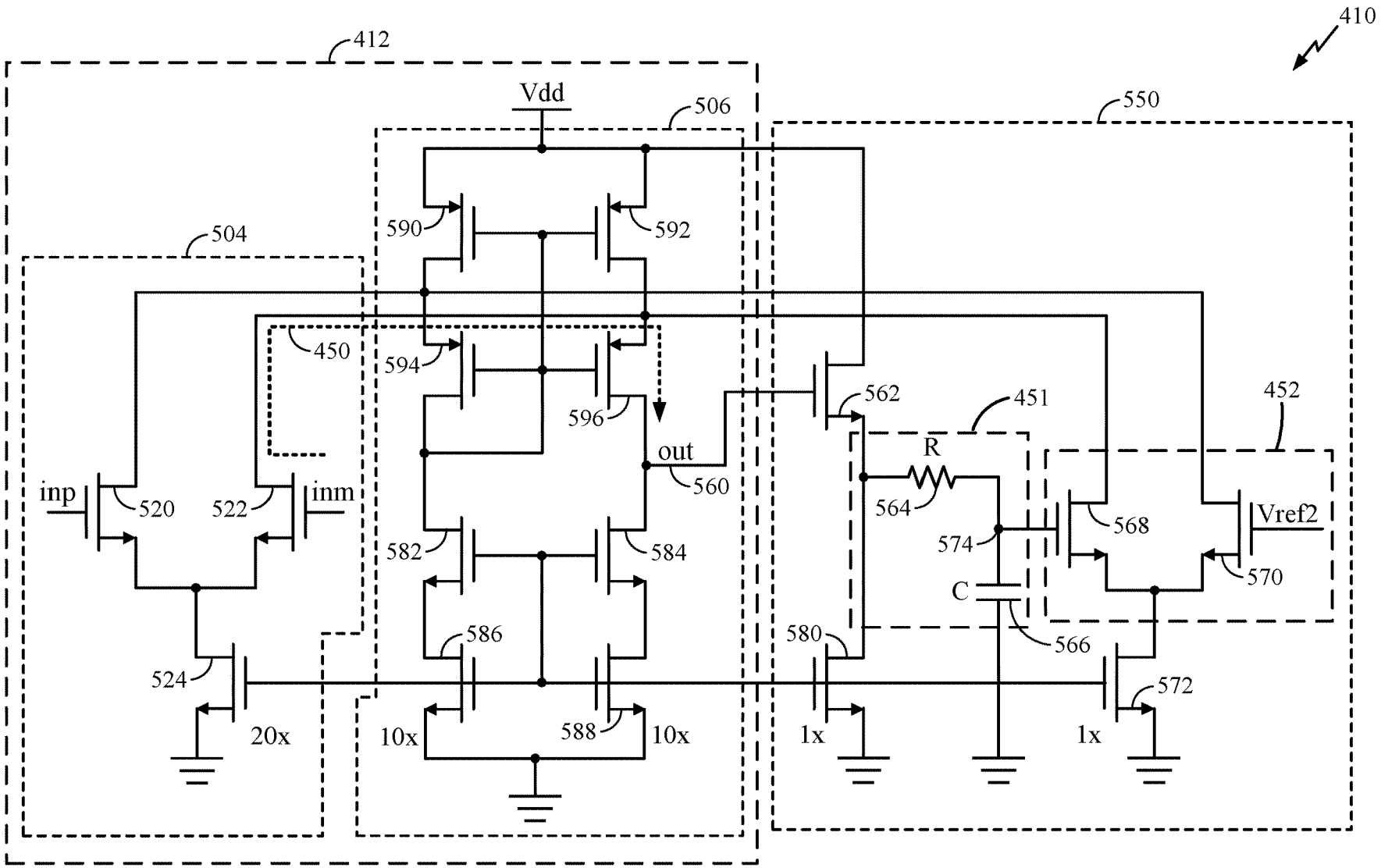
FIG. 5 illustrates a control circuit for the LDO regulator of FIG. 4, in accordance with certain aspects of the present disclosure.

FIG. 5 illustrates the control circuit 410, in accordance with certain aspects of the present disclosure. In certain aspects, the amplifier 412 may be implemented using a folded-cascode topology. For example, the amplifier 412 may include a differential input circuit 504 and cascode circuit 506. The differential input circuit 504 includes a differential input transistor pair 520, 522 having gates coupled to the positive and negative input terminals of the amplifier 412. The differential input transistor pair 520, 522 is coupled to a tail current source, which may be implemented using NMOS transistor 524, for example.

As illustrated, the cascode circuit 506 includes PMOS transistors 590, 592, 594, 596 having gates coupled together and to a drain of the PMOS transistor 594. The cascode circuit 506 also includes NMOS transistors 582, 584, 586, 588 having gates coupled together. The drains of the PMOS transistor 596 and the NMOS transistor 584 are coupled to the output of the amplifier 412, as illustrated.

As illustrated, a DC feedback circuit 550 is coupled to the output of the amplifier 412, at the output node 560. That is, the DC feedback circuit 550 includes an amplification stage (e.g., a buffer implemented using a source follower circuit) implemented using transistor 562 and a current source (e.g., NMOS transistor 580). The output of the amplification stage at the source of transistor 562 is coupled to a LPF, implemented using a resistive element 564 and a capacitive element 566. The DC feedback circuit 550 also includes a transconductance circuit 452 having a transistor pair 568, 570. The sources of the transistor pair 568, 570 are coupled to a current source implemented using NMOS transistor 572. The gate of transistor 568 is coupled to the LPF at node 574 between the resistive element 564 and the capacitive element 566. The gate of transistor 570 is coupled to another reference voltage node Vref2. The transconductance circuit 452 converts the voltage (e.g., representing the DC offset of the amplifier 412) at the output of the LPF at node 574 to a current that is sunk from the cascode circuit 506, effectively adjusting the output voltage of the control circuit 410 to cancel (or at least reduce) any DC component present in the output voltage of the control circuit 410.

In certain aspects, the DC feedback circuit 550 may consume a fraction of the current consumed by the amplifier 412. For example, the gates of the NMOS transistors 524, 586, 588, 580, 572 may be coupled together, and the size of the NMOS transistors 572, 580 may be one-twentieth the size of the NMOS transistor 524 and one-tenth the size of NMOS transistors 586, 588. Therefore, the current consumption of transconductance circuit 452 may be about one-twentieth the current consumption of the differential input circuit 504 and one-tenth the current consumption of the cascode circuit 506. Moreover, the DC feedback circuit 550 only impacts the feedback loop 450 at low frequencies due to the LPF 451, and has little to no impact on the PSRR and RPSRR of the LDO 400 at high frequencies.

Figure 6:
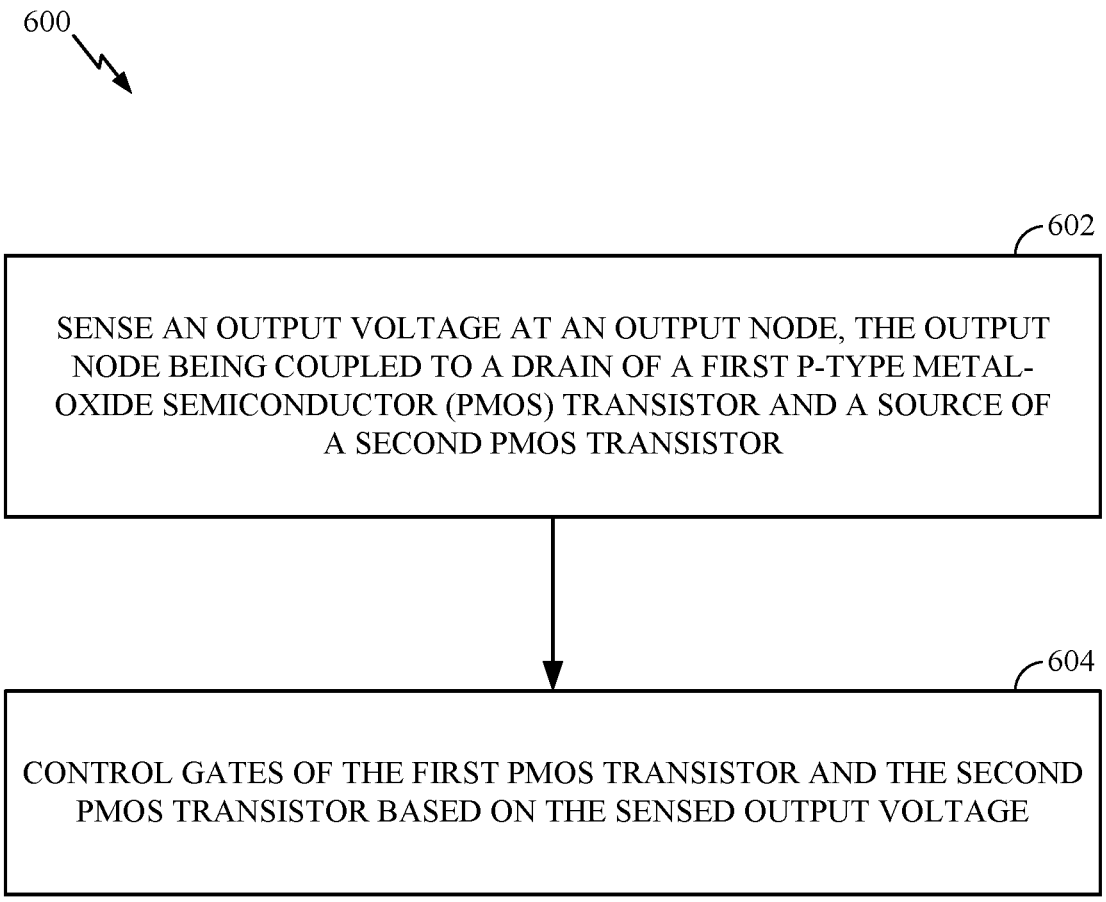
FIG. 6 is a flow diagram illustrating example operations for voltage regulation, in accordance with certain aspects of the present disclosure.

FIG. 6 is a flow diagram illustrating example operations 600 for voltage regulation, in accordance with certain aspects of the present disclosure. The operations 600 may be performed by an LDO regulator, such as the LDO regulator 400 described with respect to FIGS. 4 and 5.

The operations 600 begin, at block 602, with the LDO regulator sensing (e.g., via the amplifier 404 and the amplifier 412) an output voltage at an output node (e.g., output node 406), the output node being coupled to a drain of a first PMOS transistor (e.g., PMOS transistor 402) and a source of a second PMOS transistor (e.g., PMOS transistor 408). At block 604, the LDO regulator controls gates (e.g., via the amplifier 404 and the amplifier 412) of the first PMOS transistor and the second PMOS transistor based on the sensed output voltage.

In certain aspects, the operations 600 also include comparing (e.g., via the amplifier 404 and the amplifier 412) the sensed output voltage to a reference voltage, the gates of the first PMOS transistor and the second PMOS transistor being controlled based on the comparison. The operations 600 may also include generating (e.g., via amplifier 412) a comparison signal based on the comparison of the sensed output voltage to the reference voltage, and generating a high-pass-filtered version (e.g., via the capacitive element 414) of the comparison signal. In this case, the gate of the second PMOS transistor is controlled via the high-pass-filtered version of the comparison signal. In certain aspects, the comparison is performed via an amplifier (e.g., amplifier 412), and the operations 600 also include sensing (e.g., via the LPF 451) a DC component of the comparison signal, and providing (e.g., via transconductance circuit 452) a feedback signal to the amplifier (e.g., amplifier 412) based on the sensed DC component. In some cases, sensing the DC component may include low-pass filtering the comparison signal.

In certain aspects, the operations 600 also include biasing (e.g., via the biasing circuit 420) the second PMOS transistor via a biasing signal. In this case, the operations 600 may also include generating (e.g., via current source 426) a source-to-drain current of a third PMOS transistor, comparing (e.g., via amplifier 422) a source voltage of the third PMOS transistor to the reference voltage, and generating (e.g., via amplifier 422) the biasing signal based on the comparison. In certain aspects, the operations 600 may also include generating (e.g., via the resistive element 428 and capacitive element 414) a low-pass-filtered version of the biasing signal. In this case, the second PMOS transistor is biased via the low-pass-filtered version of the biasing signal.

The various operations of methods described above may be performed by any suitable means capable of performing the corresponding functions. The means may include various hardware component(s) and/or module(s), including, but not limited to one or more circuits. Generally, where there are operations illustrated in figures, those operations may have corresponding counterpart means-plus-function components with similar numbering. In certain aspects, means for sensing, means for controlling, means for comparing, and means for generating may comprise an amplifier, such as the amplifier 404, amplifier 422, and/or the amplifier 412. In certain aspects, means for generating may comprise a capacitive element, such as the capacitive element 414. In certain aspects, means for sensing may comprise a LPF, such as the LPF 451, the resistive element 428 and/or the capacitive element 414. In certain aspects, means for providing may comprise a transconductance circuit such as the transconductance circuit 452. In certain aspects, means for biasing may comprise a biasing circuit, such as the biasing circuit 420. In certain aspects, means for generating may comprise a current source, such as the current source 426.

As used herein, the term "determining" encompasses a wide variety of actions. For example, "determining" may include calculating, computing, processing, deriving, investigating, looking up (e.g., looking up in a table, a database, or another data structure), ascertaining, and the like. Also, "determining" may include receiving (e.g., receiving information), accessing (e.g., accessing data in a memory), and the like. Also, "determining" may include resolving, selecting, choosing, establishing, and the like.

As used herein, a phrase referring to "at least one of" a list of items refers to any combination of those items, including single members. As an example, "at least one of: a, b, or c" is intended to cover: a, b, c, a-b, a-c, b-c, and a-b-c, as well as any combination with multiples of the same element (e.g., a-a, a-a-a, a-a-b, a-a-c, a-b-b, a-c-c, b-b, b-b-b, b-b-c, c-c, and c-c-c or any other ordering of a, b, and c).

The various illustrative logical blocks, modules, and circuits described in connection with the present disclosure may be implemented or performed with discrete hardware components designed to perform the functions described herein.

The methods disclosed herein comprise one or more steps or actions for achieving the described method. The method steps and/or actions may be interchanged with one another without departing from the scope of the claims. In other words, unless a specific order of steps or actions is specified, the order and/or use of specific steps and/or actions may be modified without departing from the scope of the claims.

It is to be understood that the claims are not limited to the precise configuration and components illustrated above.

Various modifications, changes, and variations may be made in the arrangement, operation, and details of the methods and apparatus described above without departing from the scope of the claims.

What is claimed is:

1. A low drop-out (LDO) regulator, comprising:

a first p-type metal-oxide-semiconductor (PMOS) transistor having a drain coupled to an output node of the LDO regulator;

a first amplifier having an input coupled to a reference voltage node and an output coupled to a gate of the first PMOS transistor;

a second PMOS transistor having a source coupled to the output node;

a second amplifier having an input coupled to the output node and an output coupled to a gate of the second PMOS transistor; and a high-pass filter coupled between the output of the second amplifier and the gate of the second PMOS transistor.

2. The LDO regulator of claim 1, wherein the input of the second amplifier comprises a negative input terminal of the second amplifier, and wherein a positive input terminal of the second amplifier is coupled to the reference voltage node.

3. The LDO regulator of claim 1, wherein the input of the first amplifier comprises a negative input terminal of the first amplifier, and wherein a positive input terminal of the first amplifier is coupled to the output node.

4. The LDO regulator of claim 1, further comprising a biasing circuit coupled to the gate of the second PMOS transistor.

5. The LDO regulator of claim 4, further comprising a low-pass filter coupled between the biasing circuit and the gate of the second PMOS transistor.

6. The LDO regulator of claim 4, wherein the biasing circuit comprises:

a current source;

a third PMOS transistor having a gate coupled to the gate of the second PMOS transistor and a source coupled to the current source; and a third amplifier having an input coupled to the source of the third PMOS transistor and an output coupled to the gate of the third PMOS transistor.

7. The LDO regulator of claim 6, further comprising a low-pass filter coupled between the gate of the third PMOS transistor and the gate of the second PMOS transistor.

8. The LDO regulator of claim 6, wherein the input of the third amplifier comprises a negative input terminal of the third amplifier, and wherein a positive input terminal of the third amplifier is coupled to the reference voltage node.

9. The LDO regulator of claim 1, further comprising:

a transconductance circuit having an output coupled to the second amplifier; and a low-pass filter coupled between the output of the second amplifier and an input of the transconductance circuit.

10. The LDO regulator of claim 9, further comprising:

an amplification stage coupled between the output of the second amplifier and the low-pass filter.

11. The LDO regulator of claim 10, wherein the amplification stage comprises a source follower circuit.

12. The LDO regulator of claim 11, wherein the source follower circuit comprises an n-type metal-oxide-semiconductor (NMOS) transistor having a gate coupled to the output of the second amplifier and a source coupled to the low-pass filter.

13. A method for voltage regulation, comprising:

sensing an output voltage at an output node, the output node being coupled to a drain of a first p-type metal-oxide-semiconductor (PMOS) transistor and a source of a second PMOS transistor;

controlling gates of the first PMOS transistor and the second PMOS transistor based on the sensed output voltage;

comparing the sensed output voltage to a reference voltage, the gates of the first PMOS transistor and the second PMOS transistor being controlled based on the comparison;

generating a comparison signal based on the comparison of the sensed output voltage to the reference voltage; and generating a high-pass-filtered version of the comparison signal, wherein the gate of the second PMOS transistor is controlled via the high-pass-filtered version of the comparison signal.

14. The method of claim 13, wherein the comparison is performed via an amplifier, the method further comprising:

sensing a direct-current (DC) component of the comparison signal; and providing a feedback signal to the amplifier based on the sensed DC component.

15. The method of claim 14, wherein sensing the DC component comprises low-pass filtering the comparison signal.

16. The method of claim 13, further comprising biasing the second PMOS transistor via a biasing signal.

17. The method of claim 16, further comprising:

generating a source-to-drain current of a third PMOS transistor;

comparing a source voltage of the third PMOS transistor to a reference voltage; and generating the biasing signal based on the comparison.

18. The method of claim 17, further comprising:

generating a low-pass-filtered version of the biasing signal, wherein the second PMOS transistor is biased via the low-pass-filtered version of the biasing signal.

19. An apparatus for voltage regulation, comprising:

means for sensing an output voltage at an output node, the output node being coupled to a drain of a first p-type metal-oxide-semiconductor (PMOS) transistor and a source of a second PMOS transistor;

means for controlling gates of the first PMOS transistor and the second PMOS transistor based on the sensed output voltage; and means for biasing the second PMOS transistor via a biasing signal, the means for biasing comprising:

means for generating a source-to-drain current of a third PMOS transistor;

means for comparing a source voltage of the third PMOS transistor to a reference voltage; and means for generating the biasing signal based on the comparison.

20. The apparatus of claim 19, wherein the means for sensing further comprises means for comparing the sensed output voltage to a reference voltage, the gates of the first PMOS transistor and the second PMOS transistor being controlled based on the comparison.

21. The apparatus of claim 20, wherein:

the means for comparing further comprises means for generating a comparison signal based on the comparison of the sensed output voltage to the reference voltage; and the apparatus further comprises means for generating a high-pass-filtered version of the comparison signal, wherein the gate of the second PMOS transistor is controlled via the high-pass-filtered version of the comparison signal.

22. The apparatus of claim 21, further comprising:

means for sensing a direct-current (DC) component of the comparison signal; and means for providing a feedback signal to the means for comparing based on the sensed DC component.

23. The apparatus of claim 22, wherein means for sensing the DC component comprises means for low-pass filtering the comparison signal.

24. The apparatus of claim 19, further comprising means for generating a low-pass-filtered version of the biasing signal, wherein the second PMOS transistor is biased via the low-pass-filtered version of the biasing signal.

* * * * *